United States Patent [19]

Keranen

[11] 4,191,066

[45] Mar. 4, 1980

[54] PUSHBUTTON LOCKING ATTACHMENT WITH TOLERANCE COMPENSATING LATCH

[75] Inventor: John J. Keranen, Sussex, Wis.

[73] Assignee: Eaton Corporation, Cleveland, Ohio

[21] Appl. No.: 817,361

[22] Filed: Jul. 20, 1977

[51] Int. Cl.[2] ..... G05G 5/06

[52] U.S. Cl. ..... 74/527; 200/42 R

[58] Field of Search ..... 74/527; 200/42 R, 42 T, 200/321, 328, 42 A

[56] References Cited

U.S. PATENT DOCUMENTS

| | | | |
|---|---|---|---|
| 1,550,031 | 8/1925 | Kovar et al. | 200/42 T X |
| 2,523,125 | 9/1950 | Ley | 200/328 X |
| 2,876,302 | 3/1959 | Flocken | 200/42 R X |
| 3,267,245 | 8/1966 | Vincent | 200/328 X |
| 3,283,608 | 11/1966 | Davis et al. | 74/527 |
| 3,321,589 | 5/1967 | Persia et al. | 200/42 R |
| 3,511,954 | 5/1970 | Di Pilla | 200/328 X |
| 3,514,564 | 5/1970 | Di Pilla | 200/328 X |
| 3,604,868 | 9/1971 | Batcheller et al. | 200/42 T X |

*Primary Examiner*—Samuel Scott

*Assistant Examiner*—G. Anderson

*Attorney, Agent, or Firm*—Hugh R. Rather; William A. Autio

[57] ABSTRACT

A latching and locking arrangement for pushbutton controls is disclosed. A latch carries a plunger resiliently biased by a compression spring having a stronger rating than a pushbutton return spring. The latch is pivoted so that the plunger engages and depresses the pushbutton, after which the latch is translationally moved along its pivotal axis to a latched position wherein a pivot stop prevents rotation of the latch whereby the pushbutton is retained in a depressed position by the plunger. The resiliently biased plunger compensates tolerance deviations between the latched position of the latch and the depressed position of the pushbutton, which deviations were not compensated by an integral solid arm portion of the latch formerly used to hold the pushbutton in a depressed position. An improved pivot stop for the latch is also disclosed. Provision is made for padlock hasp insertion when the latch is in its latched position whereby the pushbutton may be locked in its depressed position.

2 Claims, 3 Drawing Figures

PUSHBUTTON LOCKING ATTACHMENT WITH TOLERANCE COMPENSATING LATCH

BACKGROUND OF THE INVENTION

The present invention relates to an improvement over the "Pushbutton Latching and Locking Attachment" disclosed in C. C. Davis et al U.S. Pat. No. 3,283,608, issued Nov. 8, 1966, assigned to the assignee of the present invention, and hereby incorporated herein by reference.

The Davis et al Patent discloses a latch which is pivoted to depress a pushbutton and then moved translationally to a latched position. A solid integral arm portion of the latch engages and holds the pushbutton depressed. Thus, tolerances must be held to close specifications to ensure that the arm of the latch holds the pushbutton in a sufficiently depressed position past its trip point.

SUMMARY OF THE INVENTION

An object of the invention is to provide an improved latching arrangement for pushbutton controls.

Another object is to provide an improved latch having resilient tolerance compensating means holding a pushbutton in a depressed position.

Another object is to provide an improved pivot stop for the latch in its latched position.

Other objects and advantages will hereinafter appear.

DESCRIPTION OF THE PREFERRED EMBODIMENT

Figure 1:
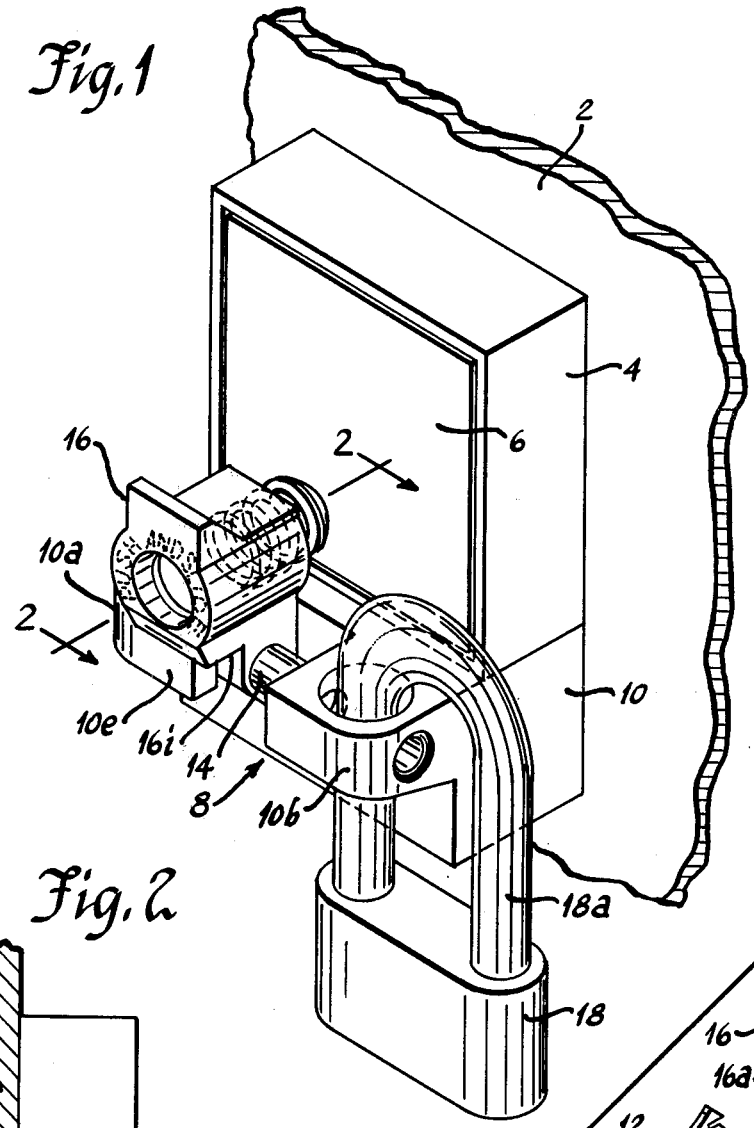
FIG. 1 is an isometric view of a pushbutton control having a latching attachment constructed in accordance with the invention and shown in locked position with a padlock.

FIG. 1 shows a cut-away support member 2 mounting a pushbutton frame 4 having a depressible pushbutton 6 for operating contact means therebehind, as described in said Davis et al patent.

Figure 3:
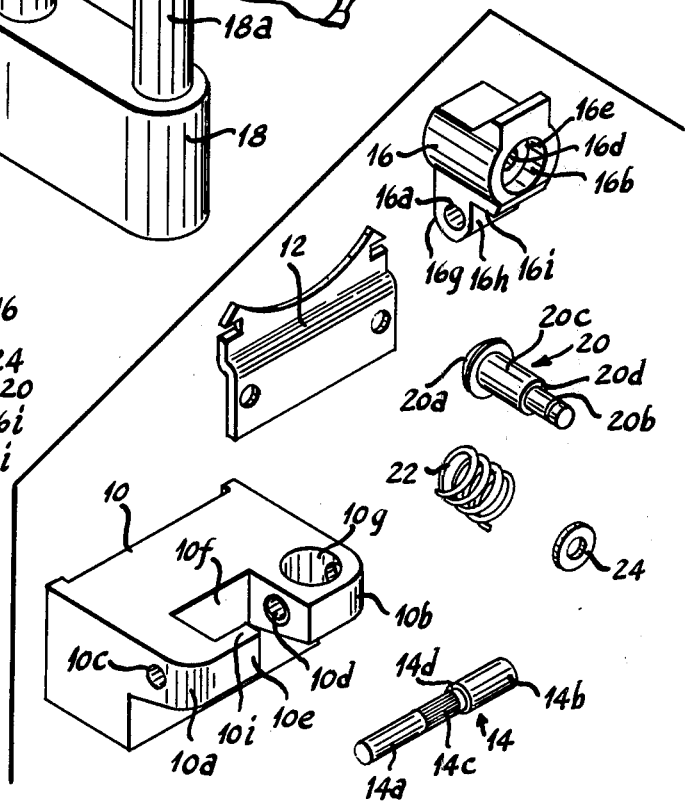
FIG. 3 is an exploded isometric view of the latching attachment.

The latching attachment, generally designated 8, has a base 10 mounted to support 2 by mounting plate 12 adjacently beneath frame 4. The base has spaced forwardly extending portions 10*a* and 10*b* having aligned longitudinally extending apertures 10*c* and 10*d*, respectively. A pin 14 is rotatably and slidably mounted in the apertures; smaller diametered portion 14*a* being received in smaller diametered aperture 10*c*, and larger diametered portion 14*b* being received in larger diametered aperture 10*d*. The pin is rotatable about its longitudinal axis and is slidable left-right, FIGS. 1 and 3.

The pin has a straight knurled central portion 14*c* which is non-rotatably force fitted through aperture 16*a* of latch 16. The latch and base are thus assembled by first disposing latch 16 in the gap between portions 10*a* and 10*b*, and then driving pin 14 leftwardly, first through aperture 10*d* then aperture 16*a* then aperture 10*c*.

Portion 10*a* of the base has a hook portion 10*e* extending rightwardly from the forwardmost end thereof to form a rectangular notch 10*f*. Latch 16 may be pivoted toward the pushbutton control to depress the pushbutton, after which the latch may be slid leftwardly into the notch to retain the latch in its pivoted position and the pushbutton depressed.

Portion 10*b* of the base has an aperture 10*g* extending vertically therethrough intersecting aperture 10*d*. When the latch is slid leftwardly, pin portion 14*b* moves leftwardly out of aperture 10*g*, thus allowing insertion of the hasp 18*a* of a padlock 18, whereby to lock latch 16 and pin 14 in the leftmost position with the pushbutton depressed. Aperture 16*a* of the latch has a smaller diameter than pin portion 14*b*, and thus shoulder 14*d* of the pin stops any attempted rightward movement of the latch 16 when the pin is stopped against rightward movement by hasp 18*a*.

Figure 2:
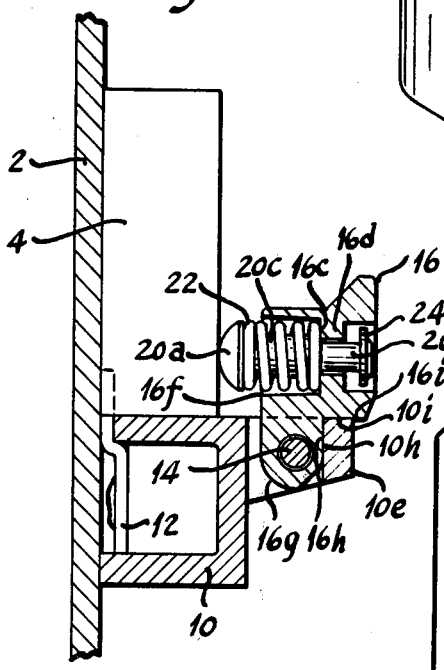
FIG. 2 is a cross-sectional view taken along line 2—2 of FIG. 1, but with the pushbutton shown in elevation.

The latch has a plunger 20 extending rearwardly through an aperture 16*b* therethrough (right to left as viewed in FIG. 2). The plunger is biased rearwardly (leftwardly in FIG. 2) by a compression spring 22 bearing between an enlarged annular rounded head portion 20*a* and an annular shoulder portion 16*c* of the latch. Aperture 16*b* has a constricted central portion 16*d* slidably receiving the plunger portion 20*b* and forming shoulder 16*c* on the rear side thereof and shoulder 16*e* on the front side thereof. The compression spring concentrically surrounds plunger portion 20*c* and is disposed in the rear section 16*f* of aperture 16*b*.

A retaining washer 24 is mounted to the front end of the plunger by peening the plunger end thereover, and thus retain the plunger in the latch when in unlatched position by providing stopping engagement of shoulder 16*e* and washer 24.

While the latch of said Davis et al patent uses a solid integral arm to hold the plunger depressed, the present invention uses a resiliently biased plunger in order to compensate for tolerance deviations in the latch attachment, pushbutton control, etc. Spring 22 is calibrated stronger than the pushbutton return spring and thus the plunger will hold the pushbutton in a fully depressed position. The Davis et al integral arm can only hold the pushbutton depressed as far as the arm extends, which may not be desirable if the pushbutton or contact means has a long pretravel. Furthermore, the Davis latch may initially be pivoted slightly further than its final pivoted latched position in order to allow clearance into notch 10*f* for leftward sliding of the latch.

The present latch thus compensates for tolerance deviations by providing resilient means which take-up the difference and ensure pushbutton depression past the trip point of the contact means. The plunger is also provided with an annular shoulder 20*d* formed by the junction of larger diametered rear portion 20*c* and smaller diametered front portion 20*b*, which shoulder 20*d* provides a definite mechanical stop against shoulder 16*c* of the latch which acts as a backstop in case compression spring 22 is overridden.

Hook portion 10*e* of the base provides the pivot stop for latch 16. The latch has a lower extending portion 16*g* which fits in notch 10*f*. Vertical side 16*h*, FIG. 3, of portion 16*g* of the latch is stopped against vertical wall 10*h*, FIG. 2, of hook portion 10*e* of the base. This pivot stop provided by engagement of vertical walls is comparable to said Davis et al latch arrangement.

The present invention, however, provides an additional pivot stop in the form of engagement of horizontal walls. The latch has a bottom horizontal surface 16*i* on its main body portion which engages top horizontal surface 10*i* of hook portion 10*e* of the base, FIG. 2. In the structural environment shown, especially the orientation of the pivotal axis of the latch with respect to the available pivot stop surfaces, it is more desirable to utilize horizontal wall engagement for a pivot stop because it provides less give, and thus greater accuracy.

It should be additionally noted that the latch can slide leftwardly from unlatching position between base portions 10*a* and 10*b* only when it is pivoted to depress the pushbutton because only then can latch portion 16*g* slide into notch 10*f*. This prevents insertion of hasp 18*a* when the pushbutton is not depressed.

It is recognized that various modifications of the disclosed preferred embodiment are possible within the scope of the appended claims.

What is claimed is:

1. A latching device for a control having a pushbutton comprising:

a base mounted to said control;

a latch having a biased plunger resiliently coupled thereto; and means mounting said latch to said base such that said latch may be moved from an off position wherein said plunger is out of engagement with said pushbutton to a first position wherein said plunger depresses said pushbutton, whereafter said latch is movable to a second latched position to retain said pushbutton in a depressed position;

said resiliently coupled biased plunger affording compensation of tolerance deviations between said latched position of said latch and said depressed position of said pushbutton;

said latch pivots toward said pushbutton to said first position and slides translationally along its pivotal axis to said latched position;

said base has a pivot stop portion which engages said latch in said latched position to prevent pivoting of said latch away from said pushbutton;

said plunger is an elongated member having an enlarged generally hemispherical head portion at the rear for engaging said pushbutton, a central cylindrical portion, and a front smaller diametered cylindrical portion;

said latch has a generally tubular portion with an aperture therethrough of different diameters, a rear aperture section, a central constricted aperture section of smaller diameter, and a front aperture section;

said plunger is disposed in said aperture in said latch for forward-rearward sliding movement, said front plunger portion being of substantially the same diameter as and guidingly supported in said central aperture section;

said front plunger portion has retaining means at the front end thereof of a diameter larger than the diameter of said central aperture section, engagement of said retaining means with the forwardly facing shoulder formed by the interface of said front and central aperture sections providing a stop for limiting rearward movment of said plunger;

said central plunger portion has a diameter larger than said central aperture section, engagement of the forwardly facing shoulder formed by the interface of said central and front plunger portions with the rearwardly facing shoulder formed by the interface of said central and rear aperture sections providing a stop for limiting forward movement of said plunger;

said plunger is biased rearwardly away from said latch towards said pushbutton by a helical compression spring concentrically surrounding said plunger in said rear aperture section and bearing between the forwardly facing shoulder formed by the interface of said enlarged head and central portions of said plunger and said rearwardly facing shoulder formed by said interface of said central and rear aperture sections.

2. The device according to claim 1 wherein said pivot stop portion engages said latch in a plane parallel to the direction of movement of said pushbutton.

* * * * *